US006511157B1

(12) United States Patent
Yoshimura et al.

(10) Patent No.: US 6,511,157 B1
(45) Date of Patent: Jan. 28, 2003

(54) INK JET PRINTERHEAD WITH A PLURALITY OF NOZZLES AND TWO DISTINCT GROUPS OF FILTERS

(75) Inventors: Hisashi Yoshimura, Nara (JP); Hajime Horinaka, Kashiba (JP); Masaharu Kimura, Daito (JP); Kohji Tsurui, Sakurai (JP); Hiroshi Onda, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 08/812,943

(22) Filed: Mar. 4, 1997

(30) Foreign Application Priority Data

Mar. 4, 1996 (JP) ..... 8-046131

(51) Int. Cl.[7] ..... B41J 2/04
(52) U.S. Cl. ..... 347/54; 347/48
(58) Field of Search ..... 347/54, 20, 68, 347/70, 94, 93, 48

(56) References Cited

U.S. PATENT DOCUMENTS

| | | | | |
|---|---|---|---|---|
| 3,946,398 A | | 3/1976 | Kyser et al. | 347/68 X |
| 5,023,625 A | * | 6/1991 | Bares et al. | 347/48 |

FOREIGN PATENT DOCUMENTS

| | | | | |
|---|---|---|---|---|
| EP | 0049900 | | 10/1981 | |
| EP | 678 387 A2 | * | 10/1995 | 347/54 |
| JP | 53-12138 | | 4/1978 | |
| JP | 55-65561 | * | 5/1980 | 347/48 |
| JP | 56-80478 | * | 7/1981 | 347/48 |
| JP | 3253345 | | 11/1991 | |
| JP | 5169650 | | 7/1993 | |

OTHER PUBLICATIONS

IBM Technical Disclosure Bulletin, vol. 30, No. 11, Variable Volume Electromagnetically–Actuated Liquid Print Head for Directly Writing on Paper, Apr. 1988.*

* cited by examiner

*Primary Examiner*—Benjamin R. Fuller
(74) *Attorney, Agent, or Firm*—Birch, Stewart, Kolasch & Birch, LLP

(57) ABSTRACT

An ink jet print head by which ink droplet ejected from all orifices are adapted to have uniform size has the following structure. Each of a plurality of ink chambers divided by partitions is communicated with a common pressure chamber with a first filter interposed. Common pressure chamber is communicated with a common ink feed path with a second filter interposed. Common pressure chamber and each of the ink chambers are covered by a pressure chamber ceiling. On pressure chamber ceiling, a piezo vibrator is provided at a position corresponding to common pressure chamber. A movable wall which is bent and deformed to the side increasing the volume is provided corresponding to each partition. By driving a piezo vibrator, a pressure wave is generated in common pressure chamber, which wave is transmitted to each ink chamber through the first filter. When movable wall is bent and deformed, the pressure wave is absorbed, so that an ink droplet is not ejected. When movable wall is not deformed, ink droplet is ejected because of the pressure wave.

17 Claims, 19 Drawing Sheets

INK JET PRINTERHEAD WITH A PLURALITY OF NOZZLES AND TWO DISTINCT GROUPS OF FILTERS

BACKGROUND OF THE INVENTION

1. Field of the Invention

The present invention relates to a ink jet print head. More specifically, it relates to an ink jet print head in which ink droplets are jetted out through orifices by increasing inner pressure of an ink chamber and fixed on a recording medium such as paper or transparent film, enabling very fine printing with high resolution.

2. Description of the Background Art

In a conventional ink jet printer disclosed in Japanese Patent Publication No. 53-12138/1978 (corresponding to U.S. Pat. No. 3,946,398), a piezo vibrator is provided facing an ink chamber, the piezo vibrator is deformed by applying an electric signal thereto so as to reduce volume of the ink chamber and increase inner pressure of the ink chamber, whereby an ink droplet is ejected from an orifice. In this method, it is necessary to provide piezo vibrators same in number as the corresponding ink ejecting channels (number of orifices). Therefore, it is difficult to reduce the size and highly dense arrangement of orifices is limited.

Ink jet print heads of other types include ones in which wall surface of an ink chamber is deformed inward to cause pressure to eject ink droplets by electrostatic force or magnetic force.

However, these methods suffer from problems that the generated pressure is too small or that the head becomes too large when necessary high pressure is to be generated.

FIG. 15 shows a schematic structure of a conventional serial print type ink jet printer. A pair of guiding rods 7 and 8 are provided parallel to a platen 6 around which a sheet of paper, not shown, is wound and fed. Along guiding rods 7 and 8, a carriage 4 is reciprocally attached. A head body 1 is mounted on carriage 4, and an ink tank 2 is mounted on body 1. Head body 1 ejects and fixes ink droplets onto the sheet of paper fed by platen 6, whereby printing is-done. Reference numeral 5 denotes a maintenance station.

FIG. 16 is a perspective view showing schematically a conventional serial print type ink jet print head. There is a nozzle 3 on the front end surface of head body 1 on which ink tank 2 is mounted.

FIG. 17 is a partially exploded perspective view showing, in enlargement, an internal structure of nozzle 3, and FIG. 18 is a cross section thereof. In nozzle 3, a number of mutually parallel partitions 15 are formed continuously and integrally from an inner bottom surface, a filter 12 is provided at a rear portion between adjacent ones of partitions 15, 15 and front end side of each partition 15 is formed to have a triangular plate shape 15*a* and faces a front surface of nozzle 3. An upper surface of the group of partitions 15 is covered and tightly sealed by a pressure chamber ceiling 16 which is integral with nozzle 3, and by adjacent partitions 15, 15, filter 12 and pressure chamber ceiling 16, a number of ink pressure chambers 11 are formed parallel to each other. Because of the triangular plate 15*a,* the front end side of each ink pressure chamber 11 is tapered, and opened as an orifice 10 at the front surface of nozzle 3. Behind the group of partitions 15 and the group of filters 12, there is formed a common ink feed path 13 surrounded by the inner bottom surface of nozzle 3 and pressure chamber ceiling 16. The common ink feed path 13 is communicated with ink tank 2 shown in FIG. 16 and receives ink supply from ink tank 2. Further, this ink feed path is communicated with each ink pressure chamber 11 with each filter 12 interposed, and supplies ink to each ink pressure chamber 11. A piezo vibrator 14 is bonded on an upper surface of pressure chamber ceiling 16 at a position corresponding to each ink pressure chamber 11. Between each piezo vibrator 14 and pressure chamber ceiling 16 which is at the ground potential, a series circuit including a power supply 17 and a switch 18 is connected individually.

The operation will be described in the following. As shown in FIG. 18, ink pressure chamber 11 is filled with ink 19. When switch 18 is off as shown in FIG. 18A, voltage is not supplied from power supply 17 to piezo vibrator 14. Accordingly, piezo vibrator 14 is not driven and hence it is kept flat. Therefore, inner pressure of ink pressure chamber 11 does not change, and equilibrium between each of ambient pressure, surface tension and ink pressure is kept at orifice 10. Accordingly, ink droplet is not ejected from orifice 10.

When switch 18 is turned on as shown in FIG. 18B, a voltage is supplied to piezo vibrator 14 from power supply 17, piezo vibrator 14 is deformed curved with the central portion projecting downward, pressure chamber ceiling 16 deforms curved downward with respect to ink pressure chamber 11 at a position corresponding to the driven piezo vibrator 14, a volume of the corresponding ink pressure chamber 11 reduces and inner pressure of ink pressure chamber 11 increases. As a result, ink 19 is forced out from orifice 10 as an ink droplet 19*a,* which jets toward a recording medium, not shown.

However, in the ink jet print head in accordance with the prior art shown in the figures, means for supplying ink uniformly to respective ink pressure chambers 11 from common ink feed path 13 is not provided. Therefore, the amount of ink 19 in respective ink pressure chambers 11 and hence inner pressure of these chambers differ from each other, and as a result, ink droplets 19*a* ejected from orifices 10 may have different sizes.

SUMMARY OF THE INVENTION

The present invention was made in view of the foregoing and its object is to provide an ink jet print head by which ink droplets ejected from all orifices are adapted to have approximately uniform size. A further object is to enable simple switching between ink droplet ejecting state and non-ejecting state. A still further object is to enable simple adjustment of the size of the ejected ink droplets.

According to an aspect of the present invention, the above described objects can be attained by an ink jet print head including a plurality of ink chambers partitioned from each other, each having, at a front end portion, an orifice; a common pressure chamber connected to the plurality of ink chambers through a first filter; a common ink feed path connected to the common pressure chamber through a second filter; a pressure generating member provided on a wall surface of the common pressure chamber; and a movable wall provided in each of the plurality of ink chambers and deformable in a direction increasing volume of the ink chamber; in which a pressure wave generated by the drive of the pressure generating member in the common pressure chamber is transmitted to each of the plurality of ink chambers through the first filter, which pressure wave is absorbed when the movable wall is deformed, and it causes an ink droplet to be ejected from the orifice when the movable wall is not deformed.

Preferably, the pressure generating member of the ink jet print head is driven periodically, and whether the ink droplet is to be ejected or not is switched by changing timing of deformation of the movable wall in the direction increasing the volume of the ink chamber with respect to the timing of driving the pressure generating member.

More preferably, the ink jet print head adjusts the size of the ejected ink droplets by changing the timing of deformation of the movable wall in the direction increasing the volume of the ink chamber with respect to the timing of driving the pressure generating member when the ink droplets are to be ejected.

More preferably, the ink jet print head further includes a highly resilient member for receiving deformation of the movable wall.

In accordance with the present invention, the common pressure chamber is separated from the common ink feed path by the second filter, and pressure wave generated by driving the pressure generating member in the common pressure chamber is supplied to each of the ink chambers through the first filter. Therefore, the amount of ink and inner pressure are uniform in every ink chamber. Accordingly, when the pressure wave from the common pressure chamber is received by the ink chambers, the ink droplets ejected from the orifices come to have uniform size.

Further, the pressure generating member is driven periodically, and by changing the timing of deformation of the movable wall in the direction increasing the volume of the ink chamber with respect to the timing of driving the pressure generating member, it is possible to switch ejection/non-ejection of ink droplets. Therefore ink droplets can be controlled in a simple manner.

Further, when the ink droplets are ejected, by changing the timing of deformation of the movable wall in the direction increasing the volume of the ink chamber with respect to the timing of driving the pressure generating member, the size of the ejected ink droplet can be adjusted. Therefore, the size of the ink droplet can be adjusted in a simple manner.

Further, a highly resilient member receiving deformation of the movable wall is provided, and therefore the movable wall deformed by the pressure wave can be received by the highly resilient member. Accordingly, parasitic vibration or undesirable deformation of movable wall by the pressure wave can be avoided, and ejection/non-ejection of ink droplets can be controlled stably.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the ink jet print head in accordance with the present invention will be described in detail with reference to the figures.

[First Embodiment]

Figure 1A:
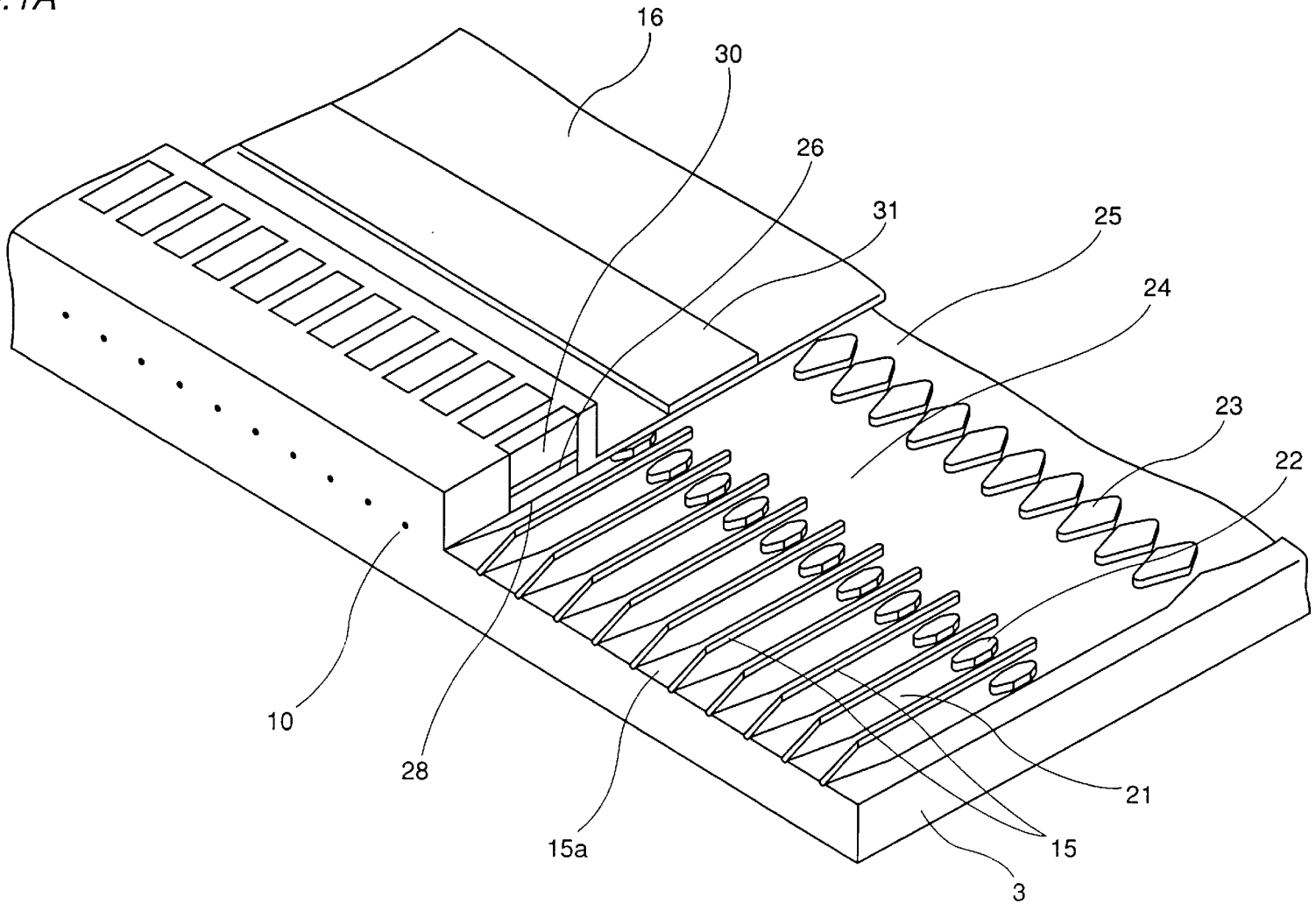
FIG. 1A is a partially exploded perspective view showing an internal structure of a nozzle of an ink jet print head in accordance with a first embodiment of the present invention.
Figure 2:
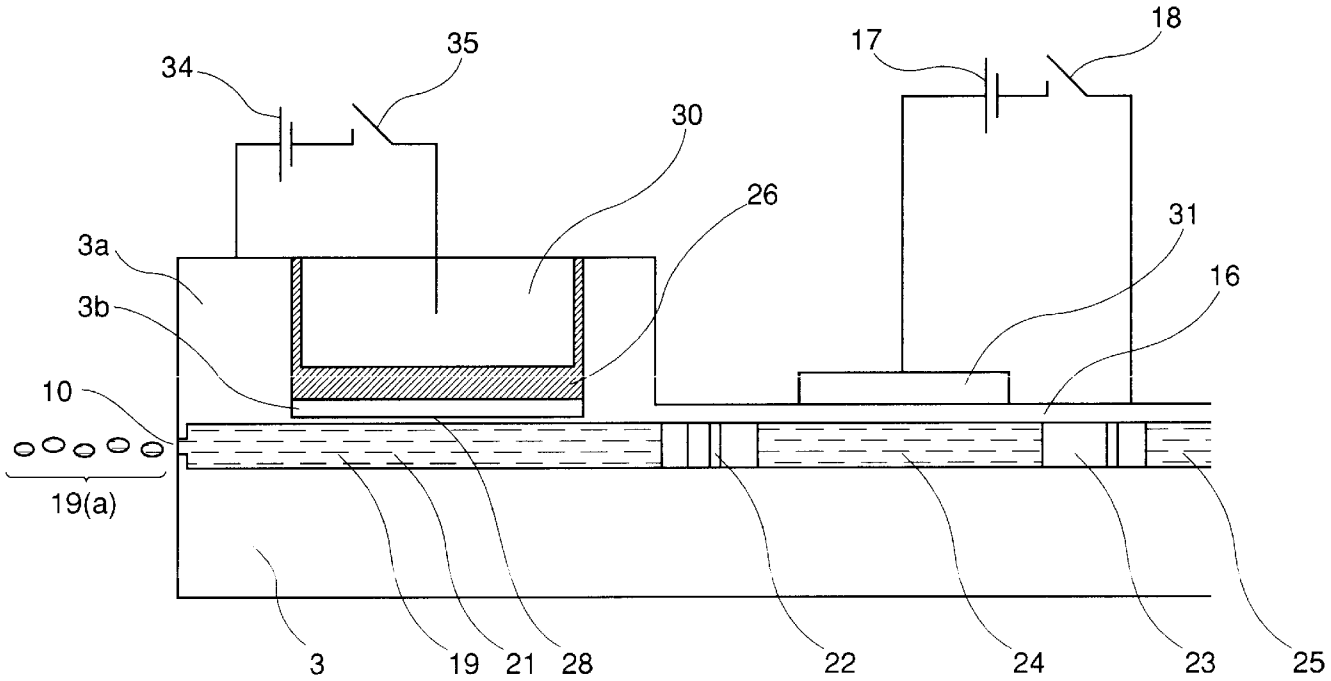
FIG. 2 is a cross sectional view showing the internal structure and ejecting operation of the nozzle in accordance with the first embodiment.

FIG. 1A is a partially exploded perspective view showing in enlargement an internal structure of a nozzle in the ink jet print head in accordance with the first embodiment, and FIG. 2 is a cross section thereof. In nozzle 3, a number of mutually parallel partitions 15 are formed continuously and integrally from an inner bottom surface, and at a rear side of adjacent partitions 15, 15, a first filter 22 is attached. A front end side of each partition 15 provides a triangular plate 15*a,* which faces the front surface of nozzle 3. Behind the group of partitions 15 and the group of first filters 22, second filters 23 are provided aligned lineally. The group of partitions 15, the group of first filters 22 and the group of second filters 23 have upper surfaces covered and tightly sealed by pressure chamber ceiling 16 which is integral with the nozzle 3. By adjacent partitions 15, 15, first filters 22 and pressure chamber ceiling 16, a number of ink chambers 21 are provided parallel to each other. Because of the triangular plate 15*a,* the front end side of each ink chamber 21 is tapered and opened as an orifice 10 at the front surface of nozzle 3. Between the group of first filters 22 and group of second filters 23, a common pressure chamber 24 surrounded by the inner bottom surface of nozzle 3 and the pressure chamber ceiling 16 is formed. Behind the group of second filters 23, a common ink feed path 25 is formed surrounded by the inner bottom surface of nozzle 3 and pressure chamber ceiling 16. The common ink feed path 25 is communicated with an ink tank, not shown, and receives ink supply from the ink tank. Further, it is communicated with common pressure chamber 24 with each of the second filters 23 interposed, and supplies ink to the common pressure chamber 24. The first filter 22 has higher fluid resistance than the second filter 23.

A single piezo vibrator 31 is bonded on an upper surface of pressure chamber ceiling 16 at a position corresponding to common pressure chamber 24, and between piezo vibrator 31 and pressure chamber ceiling 16 which is at the ground potential, a series circuit including one power supply 17 and one switch 18 is connected. In the initial state, the piezo vibrator 31 has its front surface and rear surface polarized to plus charges and minus charges, respectively. When switch 18 is turned on and a voltage from power supply 17 is applied to piezo vibrator 31, it expands in the direction of the electrodes and constricts in the surface direction. At this time, if the pressure chamber ceiling 16 on which piezo vibrator 31 is bonded is of a highly resilient member, the pressure chamber ceiling 16 deforms curved downward by unimorph effect and the volume of common pressure chamber 24 reduces. Accordingly, the inner pressure increases and a pressure wave is generated. The pressure wave is transmitted to each ink chamber 21 through each first filter 22. By the repetition of the pressure wave, ink is supplied to each of the ink chambers 21 through each of the first filters 22, so that each of the ink chambers 21 is filled with ink 19. The second filter 23 prevents the pressure wave from escaping to the side of common ink feed path 25 and assists efficient supply of the pressure wave to the ink chambers 21.

The ceiling covering the group of ink chambers 21 is a movable wall 28 which is very thin and susceptible to bending deformation. Movable wall 28 is integral with nozzle 3. At an upper surface portion of front end side of nozzle 3, a projecting portion 3*a* (see FIG. 2) is integrally formed upward, a concave portion 3*b* is formed corresponding to each ink chamber 21 at projecting portion 3*a,* an insulator 26 formed of a highly resilient member is inserted and arranged spaced by a prescribed distance from movable wall 28 in each concave portion 3*b,* and a control electrode 30 is inserted and arranged thereon. Between each control electrode 30 and projecting portion 3*a,* a series circuit including a power supply 34 and a switch 35 is connected individually. When switch 35 is turned on, movable wall 28 is bent and deformed upward by electrostatic force between control electrode 30 and flexible movable wall 28, and received by insulator 26. At this time, volume of ink chamber 21 increases. Therefore, even when a pressure wave is transmitted from common pressure chamber 24, the pressure wave is absorbed by the increased volume. Further, since movable wall 28 is received by an insulator 26 formed of a highly elastic member, parasitic vibration or deformation caused by pressure wave can be avoided. Since insulator 26 and control electrode 30 are provided in the concave portion 3*b* of projecting portion 3*a* which is integral with nozzle 3, high mechanical precision is assured and fabrication is convenient. Since movable wall 28 can be bent and deformed simply by driving with inherently weak electrostatic force, it becomes possible to mount orifices 10 with high density, and further, driving circuit can be simplified. Drops of ink 19*a* are jetted from the orifices. Since a common pressure chamber 24 is provided for all ink chambers 21 and a single piezo vibrator 31 is provided for the common pressure chamber 24, manufacturing cost can be reduced as compared where a plurality of piezo vibrators are provided separately.

Figure 1B:
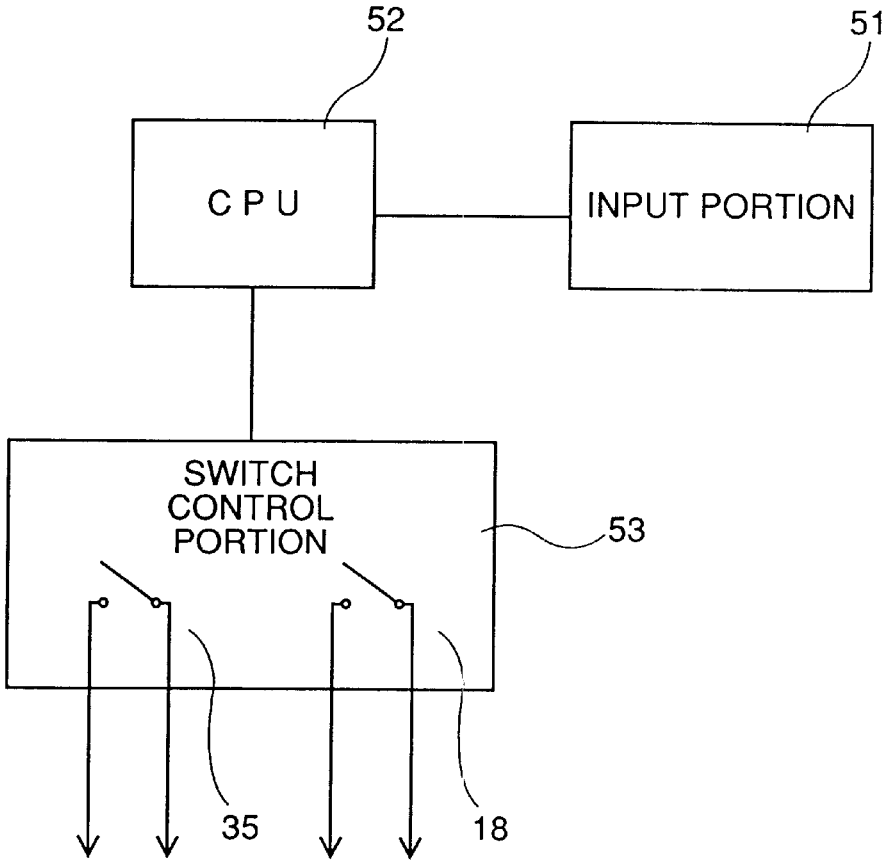
FIG. 1B is a block diagram of a nozzle driving circuit of FIG. 1A.

FIG. 1B is a block diagram of a nozzle driving circuit of the ink jet print head shown in FIG. 1A.

Referring to the figures, the circuit includes an input portion 51 to which printing information is input, a CPU52, and a switch control portion 53 for controlling switches 18 and 35 driving piezo vibrator 31 and movable wall 28.

By the operation of switch control portion 53, driving waveform is applied to piezo vibrator 31 and movable wall 28.

Figure 18A:
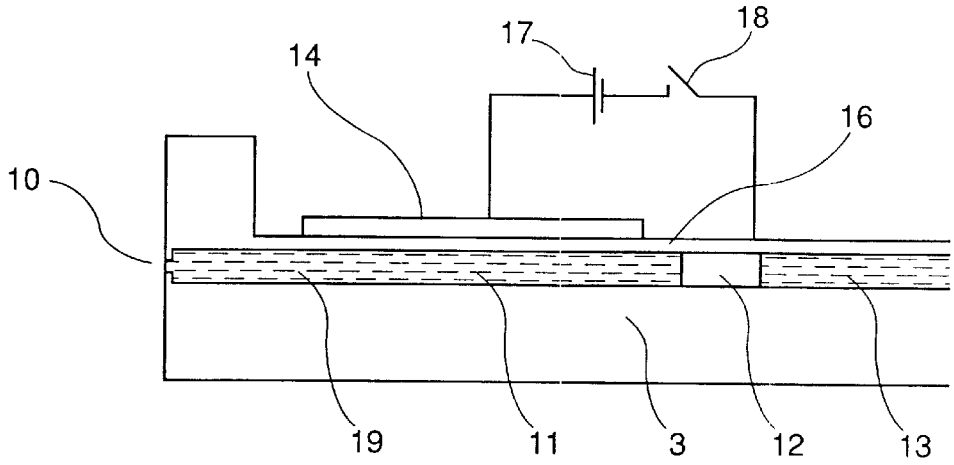
Fig. 18A PRIOR ART
FIGS. 18A and 18B are cross sections showing an internal structure of the nozzle of the conventional ink jet print head.
Figure 18B:
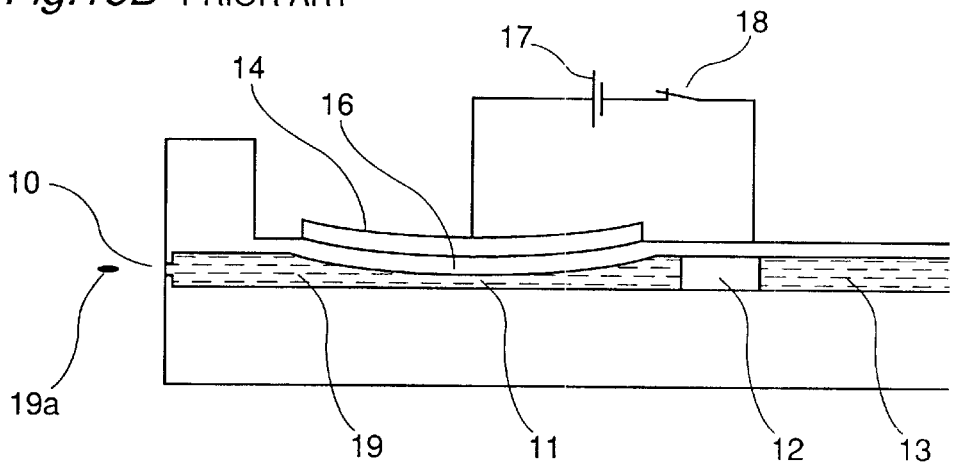
Fig. 18B PRIOR ART

The operation will be described in the following. Assume that common ink feed path 25, common pressure chamber 24 and each of the ink chambers 21 are filled with ink 19 as shown in FIG. 2. When switch 18 is periodically turned on/off constantly at a frequency corresponding to the maximum amount of ink ejection, piezo vibrator 31 together with pressure chamber ceiling 16 deform downward and returned by unimorph effect, a pressure wave is periodically generated in common pressure chamber 24, and the pressure wave is periodically transmitted through each of the first filters 22 to each of the ink chambers 21. There may be an ink chamber 21 of which corresponding switch 35 is off at the timing of arrival of pressure wave, and there may be an ink chamber 21 of which switch is on at that timing. In an ink chamber 21 of which corresponding switch 35 is off as shown in FIG. 2, inner pressure increases because of the arrived pressure wave, ink 19 is ejected as an ink droplet 19*a* (not shown in FIG. 2 but illustrated in FIG. 18B) through orifice 10, and is jetted toward a recording medium, not shown. Meanwhile, in an ink chamber 21 of which corresponding switch 35 is on as shown in FIG. 3, the volume of ink chamber 21 is increased as movable wall 28 is bent and deformed upward, and therefore the arrived pressure wave is absorbed and ink droplet 19*a* is not ejected through orifice 10.

Figures 4A, 4B, 4C, 4D:
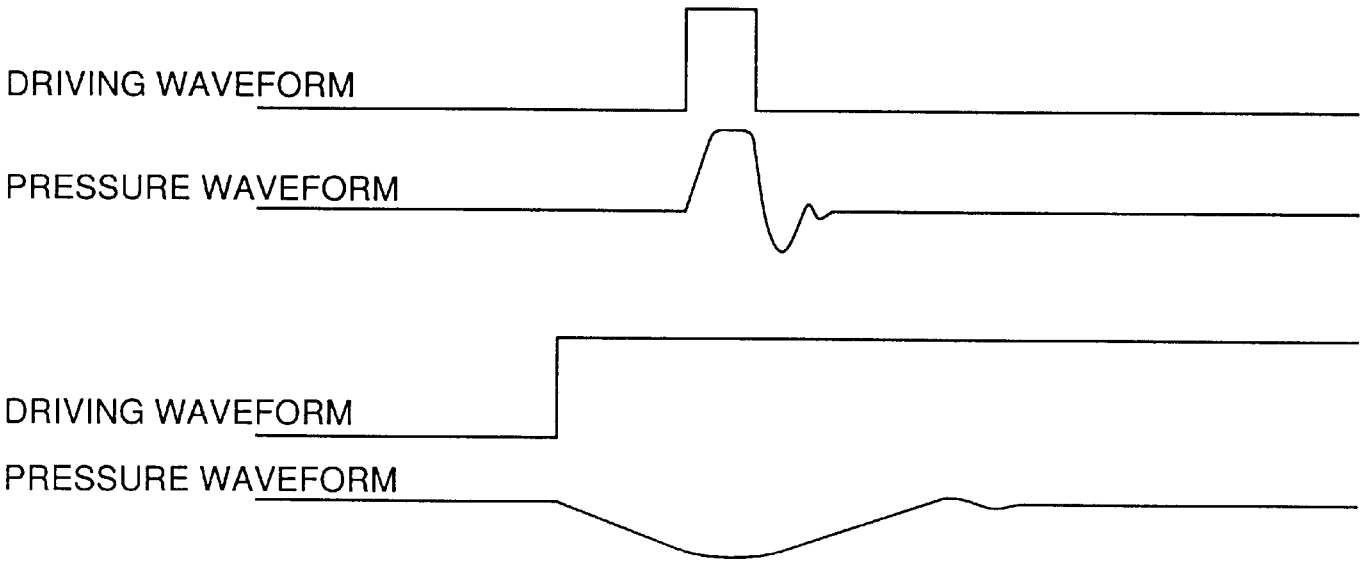
FIGS. 4A to 4D are timing charts related to the operation of the first embodiment.

This operation will be described with reference to the timing chart of FIGS. 4A to 4D. FIG. 4A shows a driving waveform applied from power supply 17 to piezo vibrator 31. FIG. 4B shows a pressure waveform in common pressure chamber 24. This pressure waveform is highly responsive to the driving waveform, which rises and falls quickly, and at the fall, it overshoots and returns to normal pressure. FIG. 4C represents driving waveform applied from power supply 34 to control electrode 30, and FIG. 4D represents pressure waveform in ink chamber 21. This pressure waveform changes to the negative side, and because of its poor response, it changes moderately. There is hardly an overshoot.

Figure 3:
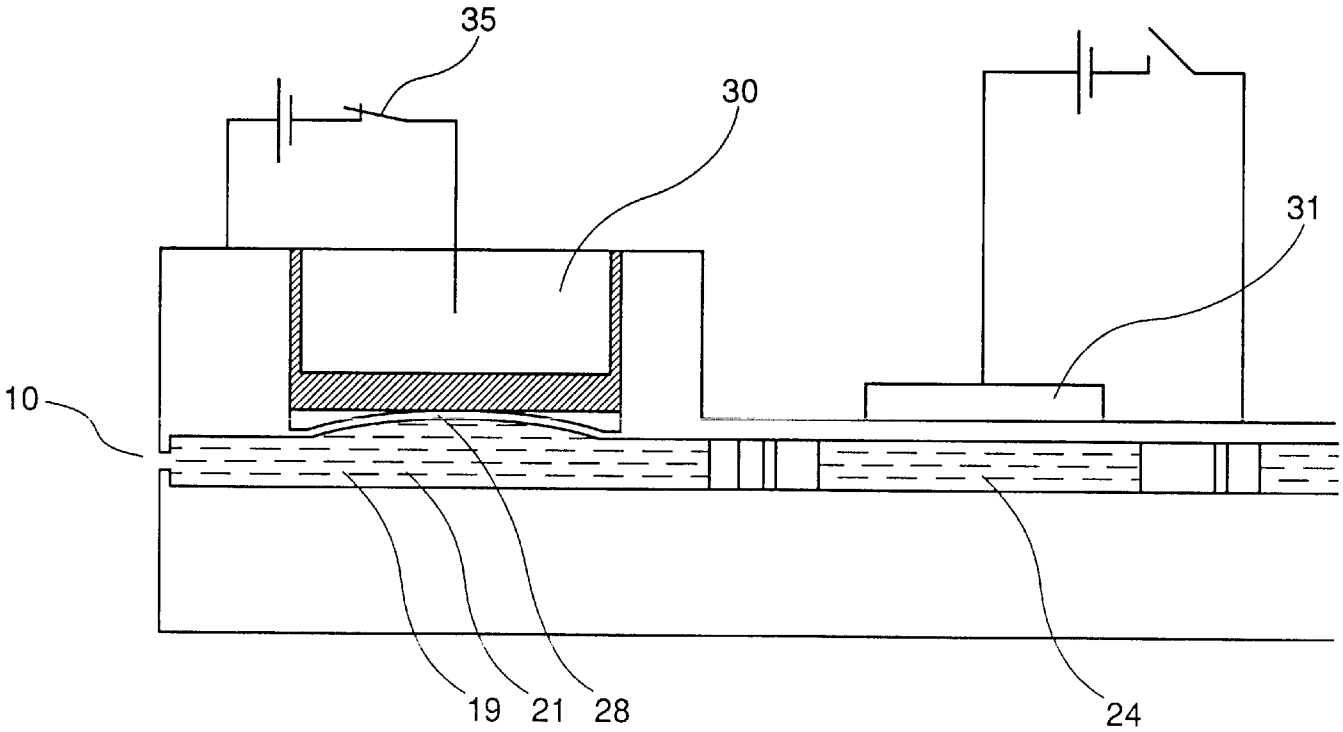
FIG. 3 is a cross sectional view showing a non-ejecting operation in accordance with the first embodiment.

If the state of FIG. 3 is desired so as not to eject ink droplet 19*a,* the timing may have to be controlled such that piezo vibrator 31 is driven at a timing when inner pressure of ink chamber 21 is reduced most to the negative side.

The first filter 22 positioned between common pressure chamber 24 and each of the ink chambers 21 is necessary to transmit the pressure wave generated by common pressure chamber 24 correctly to each ink chamber 21. If there is not the first filter 22, ink chamber 21 would also serve as a chamber generating pressure wave. In that case, the number of movable walls which are bent and deformed in accordance with the number of ink ejection vary, resulting in unstable pressure wave, which may cause counter flow of ink to the common pressure chamber 24. Further, because of the variation in pressure value of the pressure wave, the size of ink droplets 19*a* to be ejected may vary or the speed of ejection may vary. According to an experiment, when the first filter 22 having five holes of which diameter is 25 $\mu$m and length is 50 $\mu$m is provided, difference in the generated pressure wave can be suppressed to at most 10% within the minimum to maximum range of load condition, and a pressure corresponding to 80% of the pressure wave generated in common pressure chamber 24 can be transmitted to ink chamber 21 which ejects ink.

[Second Embodiment]

In the first embodiment described above, when ink droplet 19*a* is not to be ejected, movable wall 28 is considerably bent and deformed so as to increase volume of ink chamber 21. In other words, movable wall 28 has sufficient flexibility to allow significant bending deformation with inherently weak electrostatic force. However, even when ink droplet 19*a* is to be ejected with switch 35 turned off as shown in FIG. 2, it is possible that the highly flexible movable wall 28 is bent and deformed, absorbing part of the pressure wave if the pressure wave from common pressure chamber 24 is large, reducing the amount of ink droplet 19*a* to be ejected. The second embodiment addresses this problem.

Figures 5A, 5B, 5C, 5D, 5E, 5F:
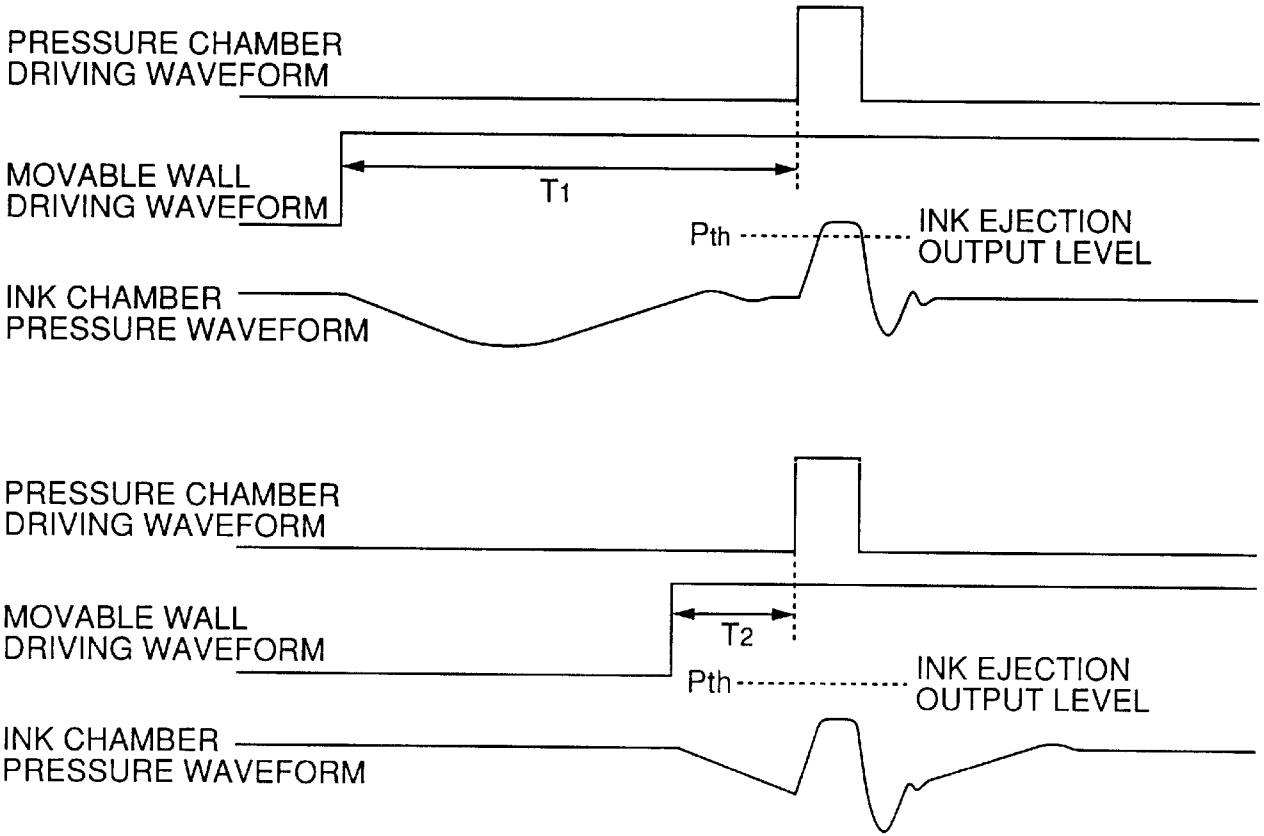
FIGS. 5A to 5F are timing charts related to the operation of the ink jet print head in accordance with the second embodiment.

In the second embodiment, timing of driving movable wall 28 is controlled. FIGS. 5A to 5C are timing charts when ink droplet 19*a* is to be ejected, while FIGS. 5D to 5F are timing charts when ink droplet 19*a* is not to be ejected.

FIG. 5A represents driving waveform of piezo vibrator 31. At a timing sufficiently long period $T_1$ before driving the vibrator, the driving waveform of movable wall 28 is raised as shown in FIG. 5B. The pressure waveform of ink chamber 21 shown in FIG. 5C has already returned to normal pressure from the negative state, as long period of time $T_1$ has passed. Therefore, if driving waveform of piezo vibrator 31 is raised as shown in FIG. 5A at that timing, the pressure waveform of ink chamber 21 which receives the pressure wave from common pressure chamber 24 becomes higher than the level Pth for ejection, and hence ink droplet 19*a* is ejected.

FIG. 5D also represents driving waveform of piezo vibrator 31. Assume that driving waveform of movable wall 28 is raised as shown in FIG. 5E at a timing $T_2$ shortly before driving the vibrator. Since pressure waveform of ink chamber 21 has not yet returned from the negative state in the short period of time $T_2$, as shown in FIG. 5F, if the driving waveform of piezo vibrator 31 is raised at that timing as shown in FIG. 5D, the pressure waveform of ink chamber 21 receiving the pressure wave from common pressure chamber 24 is lower than the level Pth of the pressure necessary for ejection, and hence ink droplet 19*a* is not ejected.

According to the second embodiment, even when the pressure of pressure wave from common pressure chamber 24 varies to some extent, ejection/non-ejection of ink droplet 19*a* can be controlled with clear distinction.

[Third Embodiment]

In the third embodiment, the timing for driving movable wall 28 is controlled with respect to the timing of driving piezo vibrator 31 so as to adjust size of the ejected ink droplet 19*a*.

Figures 6A, 6B, 6C, 6D, 6E, 6F:
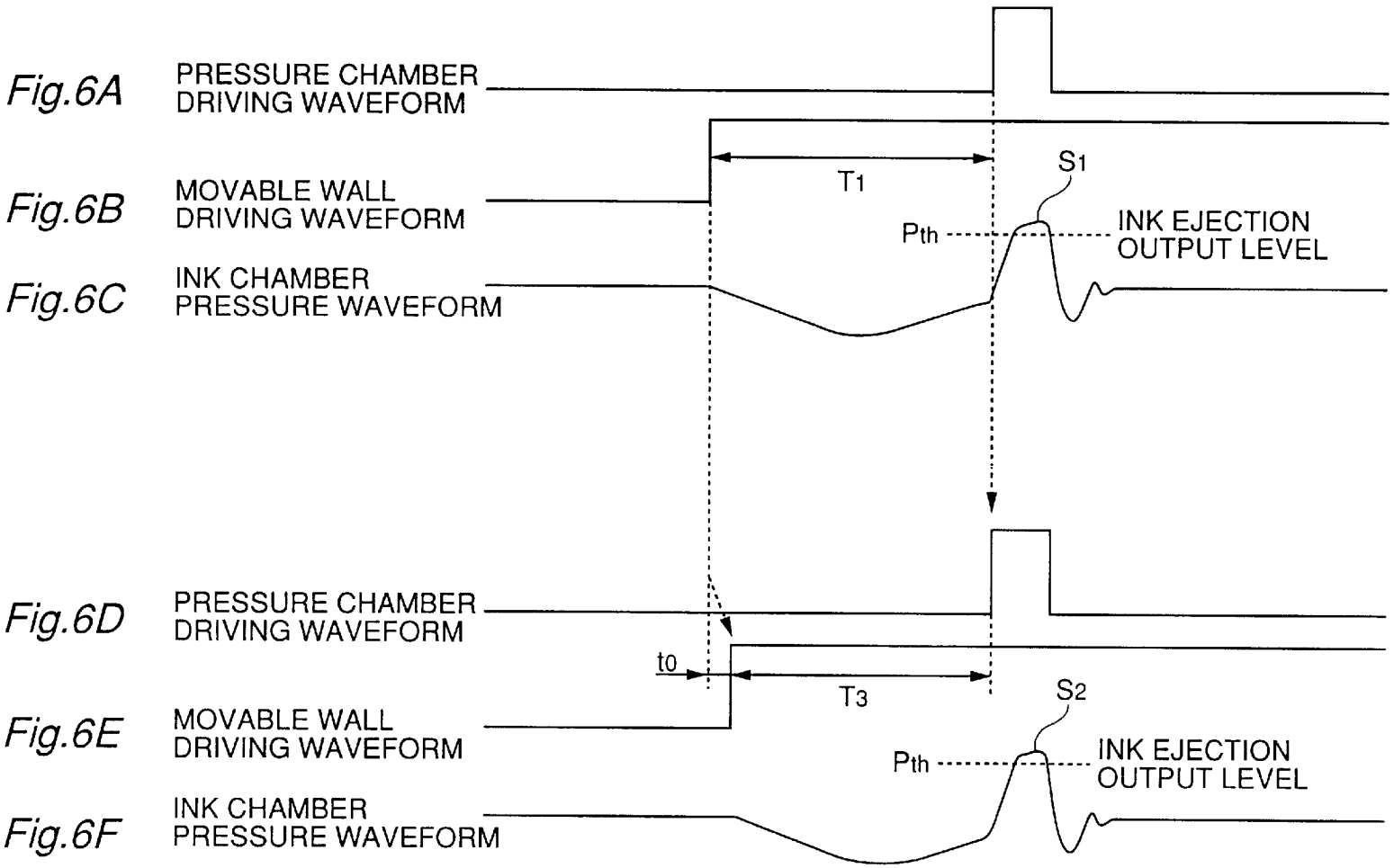
FIGS. 6A to 6F are timing charts related to the operation of the ink jet print head in accordance with a third embodiment.

FIGS. 6A to 6C are timing charts when size of ink droplet 19*a* is to be increased, while FIGS. 6D to 6F are timing charts when size of ink droplet 19*a* is to be reduced. FIG. 6A represents driving waveform of piezo vibrator 31, and driving waveform of movable wall 28 is raised at a timing sufficiently long time $T_1$ before, as shown in FIG. 6B. Since pressure waveform of ink chamber 21 has already returned to normal pressure from the negative state in the long period $T_1$, as shown in FIG. 6C, when driving waveform of piezo vibrator 31 is raised at that timing as shown in FIG. 6A, the pressure waveform of ink chamber 21 receiving the pressure wave from common pressure chamber 24 becomes higher than the level Pth of pressure necessary for ejection. The total pressure $S_1$ exceeding the ejection pressure level Pth is high, and hence ink droplet 19*a* of a large size can be ejected.

FIG. 6D also represents driving waveform of piezo vibrator 31. The driving waveform of movable wall 28 is raised at a timing a short period $T_3$ before a rise of driving waveform of vibrator 31, which time period $T_3$ is shorter by a short time period t0 than the aforementioned time period $T_1$. In the slightly shorter time period $T_3$, the pressure waveform in ink chamber 21 is approximately but not sufficiently returned from the negative state, as shown in FIG. 6F. Therefore, if the driving waveform of piezo vibrator 31 is raised at that timing as shown in FIG. 6D, the pressure waveform of ink chamber receiving the pressure wave from common pressure chamber 24 becomes higher than the level Pth of pressure necessary for ejection as in the case shown in FIG. 6C. However, the total pressure $S_2$ exceeding the ejection pressure level Pth is smaller than the pressure $S_1$ shown in FIG. 6C, and hence the size of ink droplet 19*a* becomes smaller.

According to the third embodiment, the size of ink droplet 19*a* can be adjusted in a simple manner by controlling the timing of driving movable wall 28. Further, pressure variation of pressure wave from common pressure chamber 24 can be absorbed by controlling the timing of driving movable wall 28.

[Fourth Embodiment]

Figure 7:
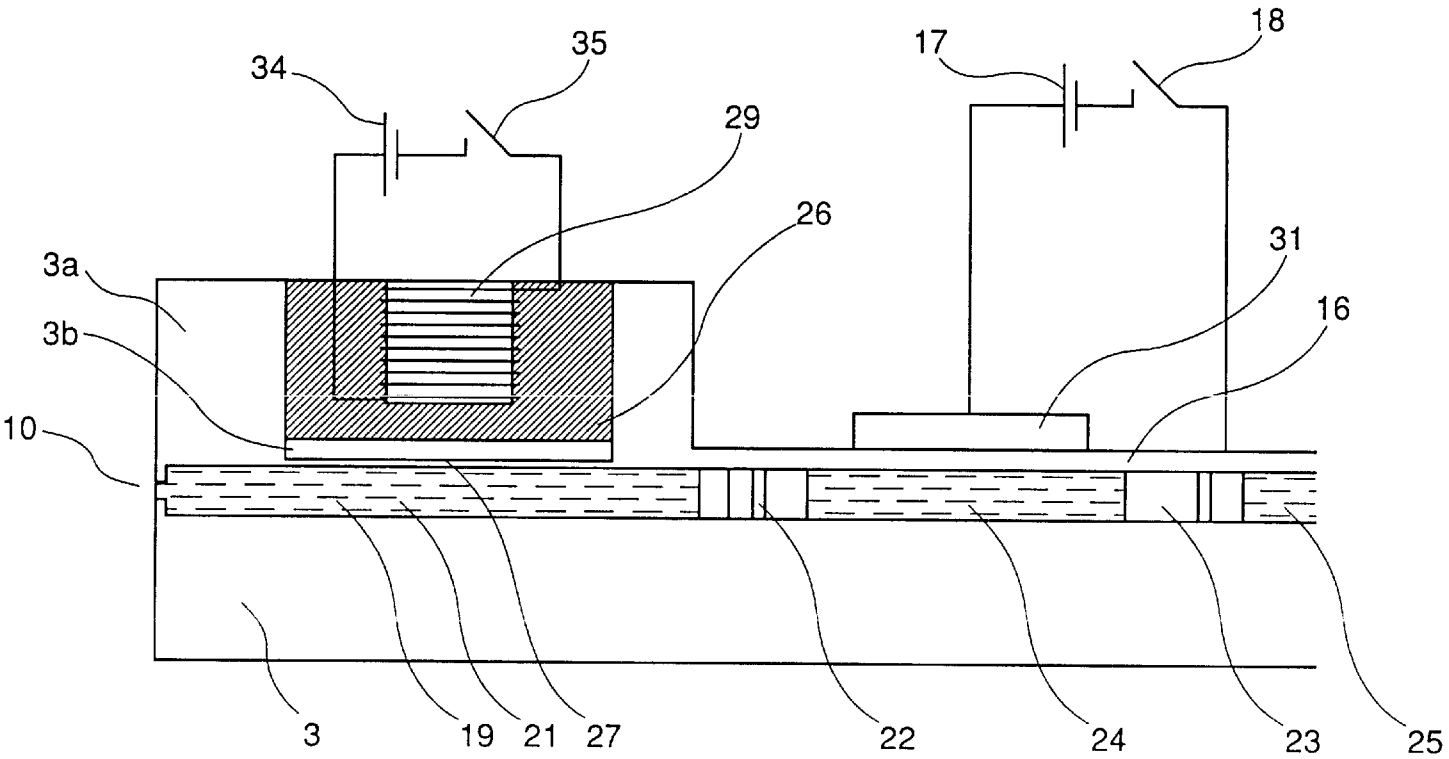
FIG. 7 is a cross section showing an internal structure of a nozzle of the ink jet print head in accordance with a fourth embodiment.
Figure 8:
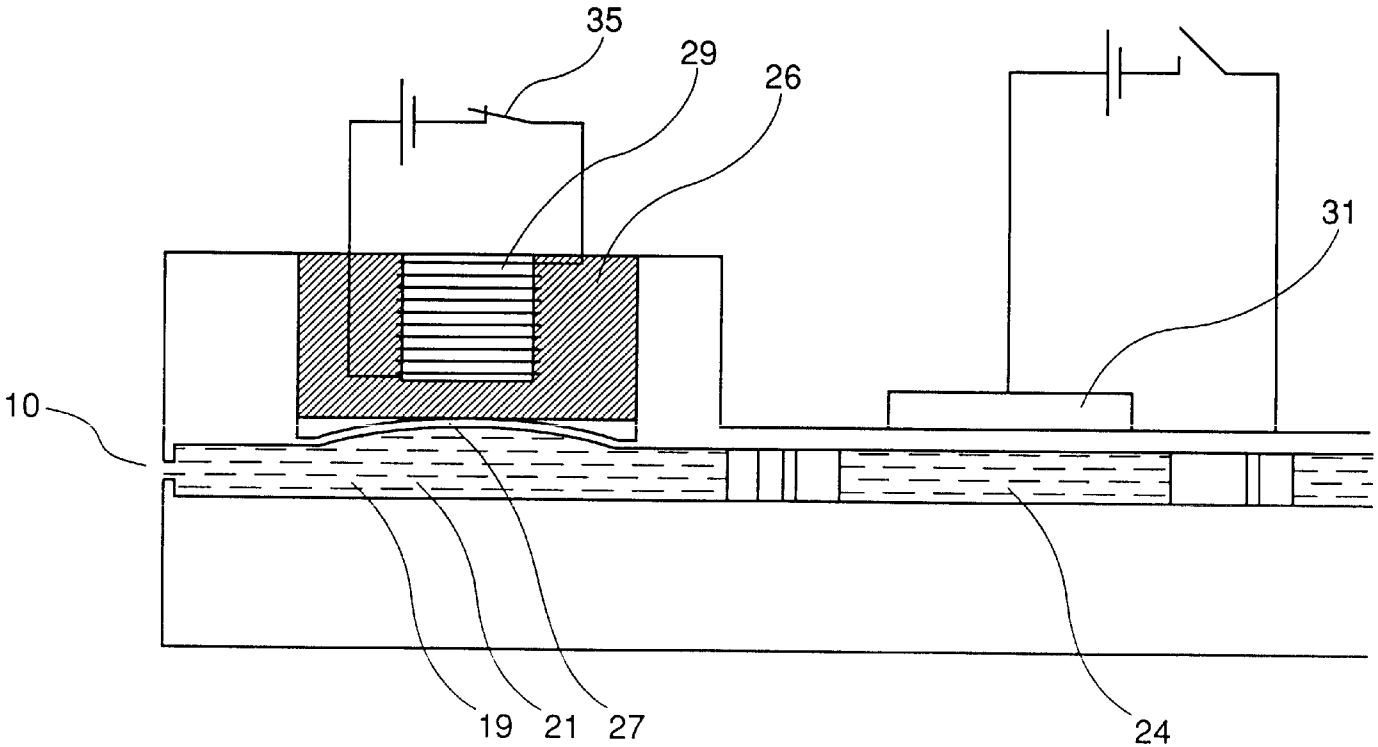
FIG. 8 is a cross section showing a non-ejecting operation of the fourth embodiment.

In the fourth embodiment, means for driving the movable wall for increasing volume of ink chamber 21 is changed from an electrostatic type to electromagnetic type means. FIG. 7 is a cross section when ink droplet is ejected and FIG. 8 is a cross section when ink droplet is not ejected. In FIGS. 7 and 8, portions corresponding to those of FIGS. 2 and 3 are denoted by the same reference characters. Briefly stated, the structure includes a nozzle 3, a projecting portion 3*a*, a concave portion 3*b*, an orifice 10, a pressure chamber ceiling 16, a power supply 17, a switch 18, ink 19, an ink chamber 21, a first filter 22, a second filter 23, a common pressure chamber 24, a common ink feed path 25, an insulator 26 formed of a highly resilient material, a piezo vibrator 31, a power supply 34 and a switch 35. Further, a movable wall 27 formed of a magnetic material and an electromagnet 29 buried in insulator 26 are provided. Movable wall 27, insulator 26 and electromagnet 29 are individually inserted and arranged in each concave portion 3*b* of projection 3*a*. A series circuit of power supply 34 and switch 35 is connected to electromagnet 29.

The operation is similar to the first embodiment. More specifically, when switch 35 is turned on and current is supplied from power supply 34 to electromagnet 29, movable wall 27 formed of a magnetic material is bent and deformed upward to be in contact with insulator 26 by magnetic absorption, volume of ink chamber 21 is thus increased and pressure wave from common pressure chamber 24 is absorbed, so that ejection of ink droplet 19*a* is prevented.

This embodiment also allows highly dense mounting and simple driving circuit.

Driving power can also be saved.

[Fifth Embodiment]

Figure 9:
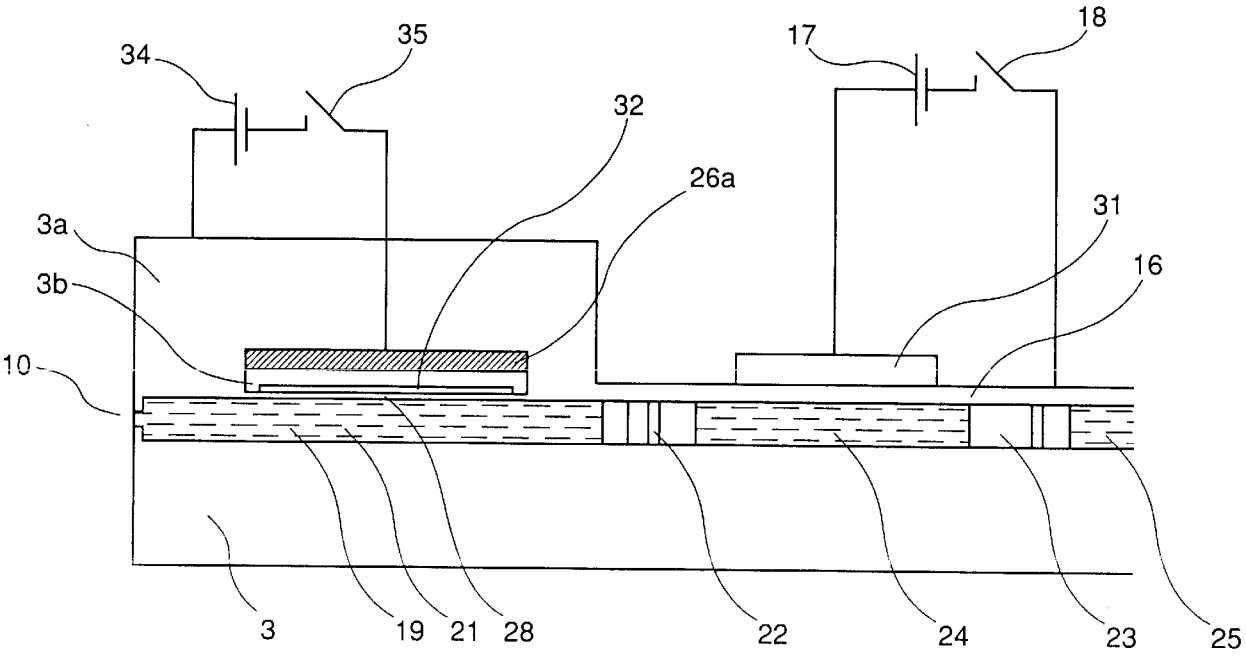
FIG. 9 is a cross section showing an internal structure of a nozzle in the ink jet print head in accordance with a fifth embodiment.
Figure 10:
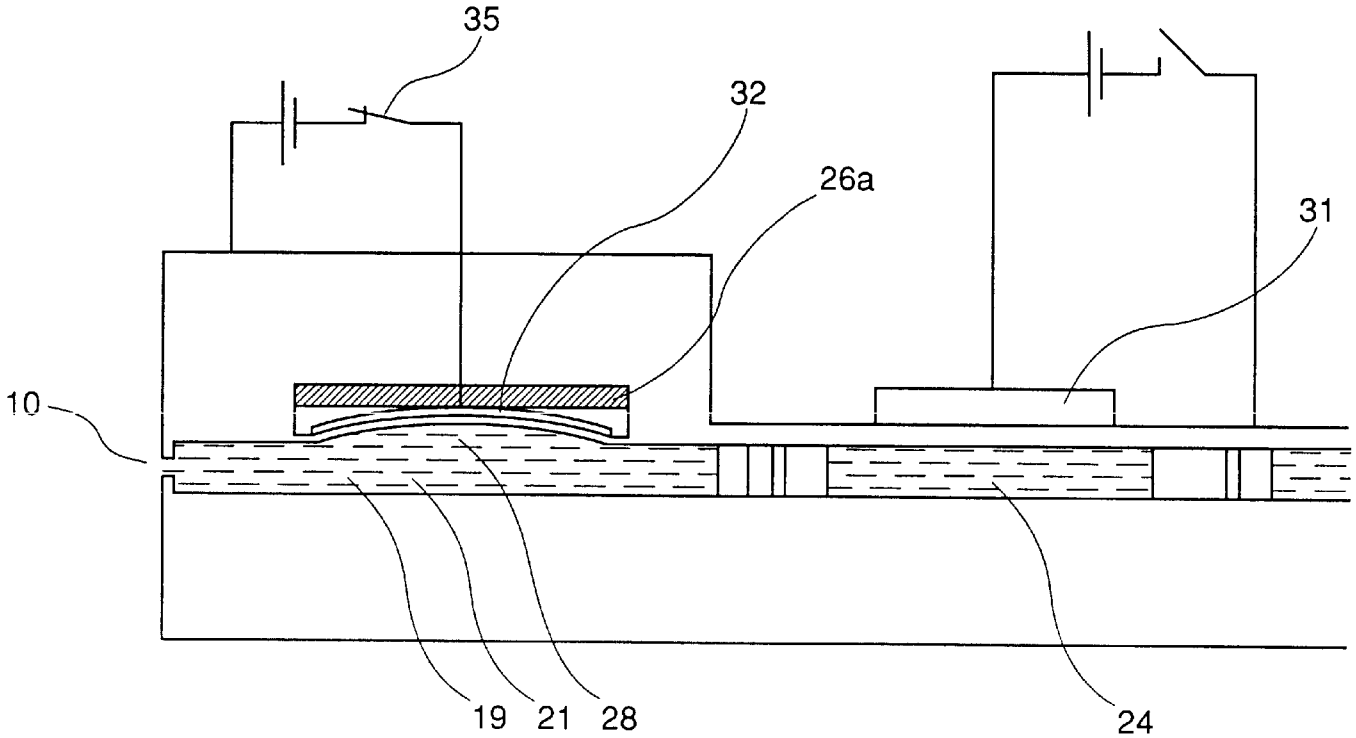
FIG. 10 is a cross section showing the non-ejecting operation in accordance with the fifth embodiment.

In the fifth embodiment, means for driving the movable wall for increasing the volume of ink chamber 21 is a piezo vibrator. FIG. 9 is a cross section when an ink droplet is ejected, and FIG. 10 is a cross section when the ink droplet is not ejected. In FIGS. 9 and 10, portions corresponding to those of FIGS. 2 and 3 are denoted by the same reference characters. Briefly stated, the structure includes a nozzle 3, a projection 3*a,* a concave portion 3*b,* an orifice 10, a pressure chamber ceiling 16, a power supply 17, a switch 18, ink 19, an ink chamber 21, a first filter 22, a second filter 23, a common pressure chamber 24, a common ink feed path 25, a movable wall 28, a piezo vibrator 31, a power supply 34 and a switch 35. Further, a thin film insulator 26*a* formed of a highly resilient material, and a thin film piezo vibrator 32 bonded in unimorph type on movable wall 28 are provided. Movable wall 28, thin film piezo vibrator 32 and thin film insulator 26*a* are individually inserted and arranged in each concave portion 3*b* of projection 3*a*. Thin film insulator 26*a* and thin film piezo vibrator 32 are arranged opposed to and spaced by a small distance from each other. A series circuit of power supply 34 and switch 35 is connected to thin film piezo vibrator 32.

Thin film piezo vibrator 32 and thin film insulator 26*a* each have a thickness of at most 10 $\mu$m. The thin film piezo vibrator 32 may be fabricated by sputtering, sol-gel method, hydrothermal method or the like. In a conventional ink jet print head, the thickness of the thin film piezo vibrator has been 50 $\mu$m or more. This is because the vibrator has been used for pressurizing ink.

By contrast, in the present embodiment, what is necessary is to attain a negative pressure. Therefore, the thickness of 10 $\mu$m or less is sufficient, and it can be driven with small energy. Further, highly dense mounting becomes possible and driving circuit therefor is simple.

The operation is similar to the first embodiment. By applying a voltage in reverse direction with respect to the direction of polarization of piezo vibrator 32, deformation takes place in the direction of extension of piezo vibrator 32, and by the unimorph effect with the wall surface, it deforms upward.

[Sixth Embodiment]

Figure 11:
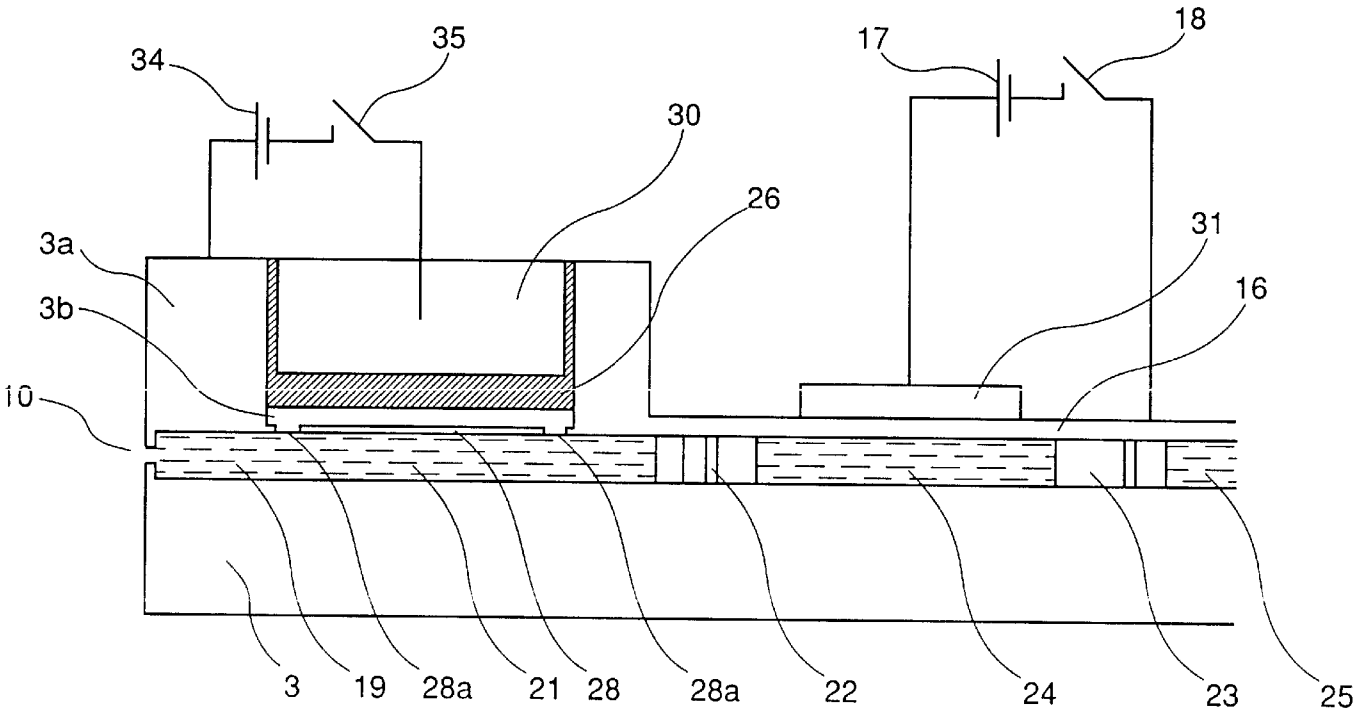
FIG. 11 is a cross section showing an internal structure of a nozzle in accordance with the ink jet print head in accordance with a sixth embodiment.

FIG. 11 is a cross section of an ink jet printer head in accordance with a sixth embodiment. The sixth embodiment is a modification of the first embodiment (FIG. 2) in which a thin film flexible portion 28*a* is formed around movable wall 28, so that bending deformation becomes possible with smaller driving force and the bent and deformed state becomes stable. Other structure and operation are similar to the first embodiment. Therefore, corresponding portions are denoted by the same reference characters and detailed description is not repeated.

[Seventh Embodiment]

Figure 12:
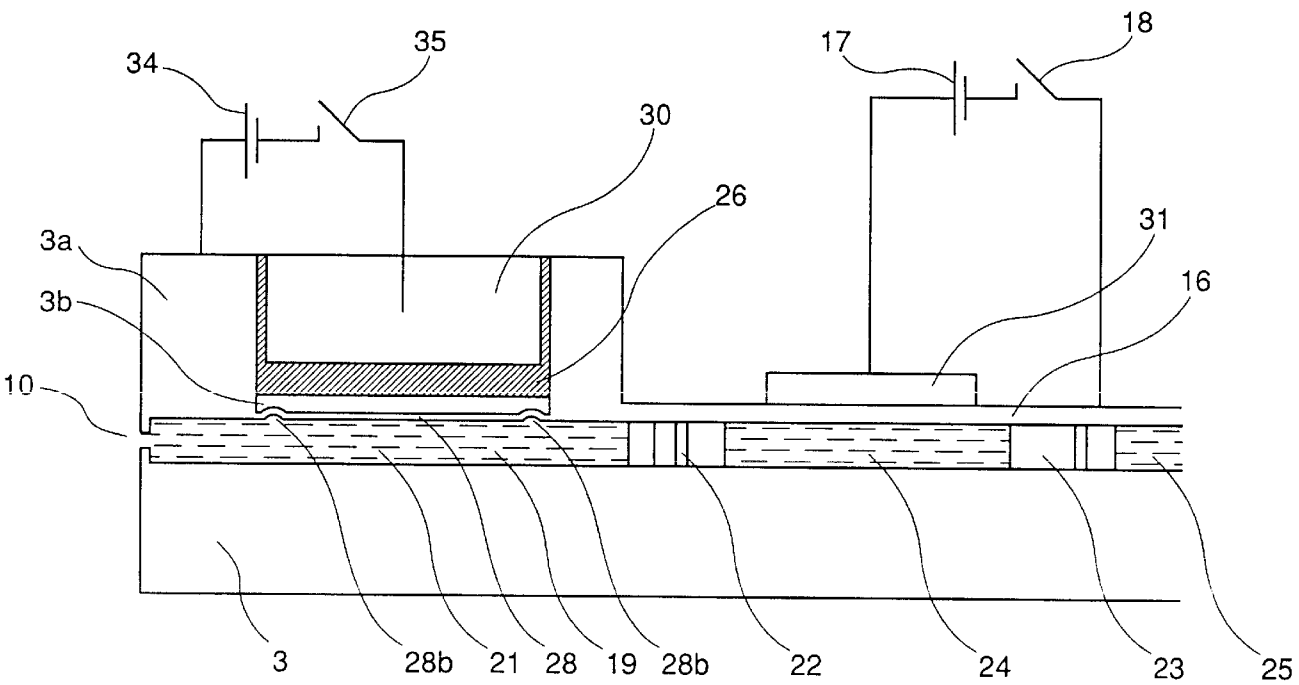
FIG. 12 is a cross section showing an internal structure of a nozzle in accordance with the ink jet print head in accordance with the seventh embodiment.

FIG. 12 is a cross section of an ink jet print head in accordance with a seventh embodiment. The seventh embodiment is a modification of the first embodiment (FIG. 2) in which a rib portion 28*b* slightly expanded upward is formed around movable wall 28. Similar to the above described embodiments, bending deformation becomes possible with smaller driving force, and bent and deformed state becomes possible. Other structure and operation are similar to the first embodiment. Therefore, corresponding portions are denoted by the same reference characters and detailed description is not repeated.

[Eighth Embodiment]

Figure 13:
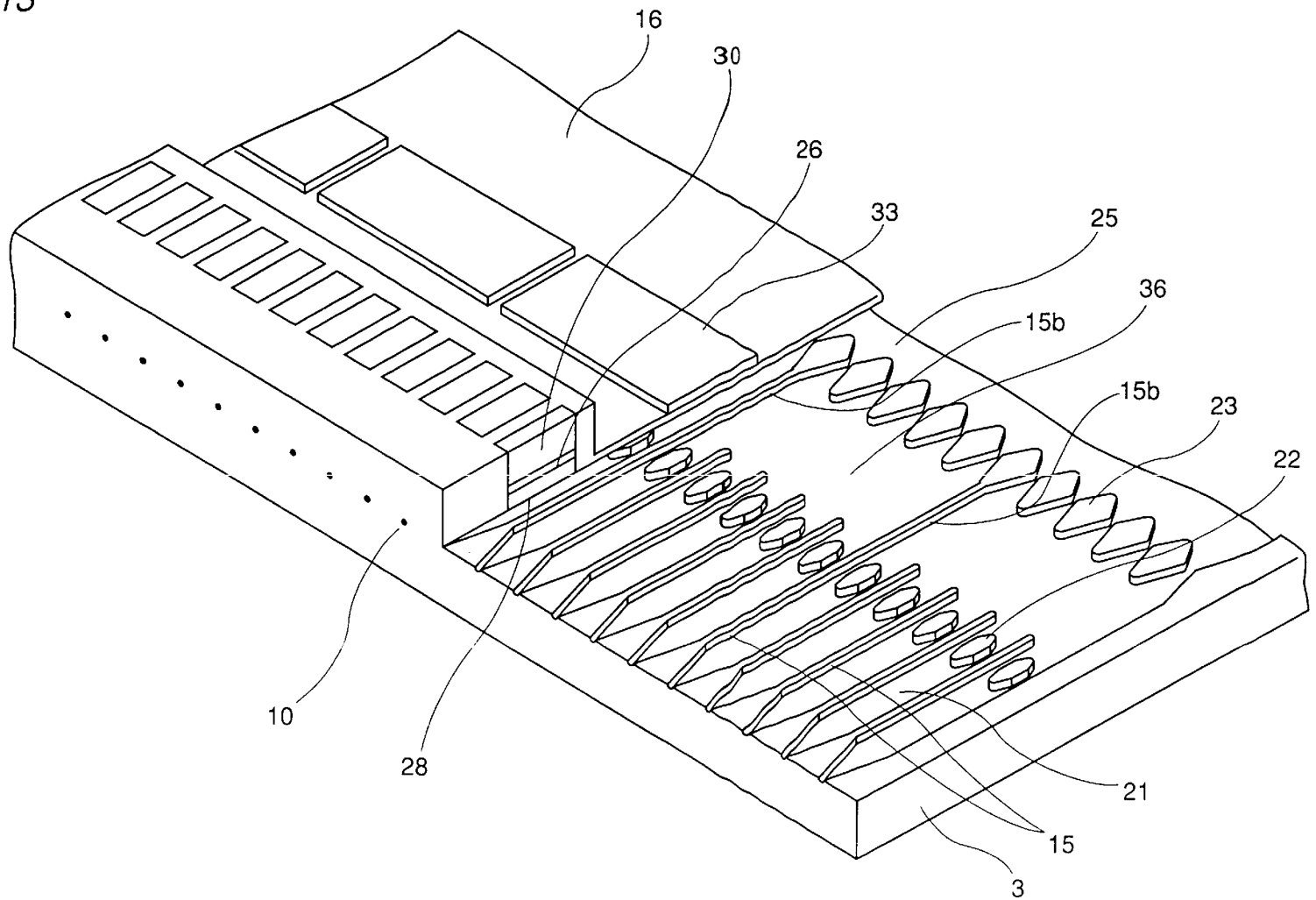
FIG. 13 is a partially exploded perspective view showing an internal structure of a nozzle in the ink jet print head in accordance with an eighth embodiment.

FIG. 13 is a partially exploded perspective view of a nozzle in an ink jet print head in accordance with an eighth embodiment. The eighth embodiment is a modification of the first embodiment (FIG. 1) in which the partition at prescribed number of ink chambers 21 is elongated to be an elongate partition 15*b,* and its rear end portion is coupled to the second filter 23. As a result, the common pressure chamber 24 of the fifth embodiment is modified to a partitioned common pressure chamber 36 divided into a plurality of sections. In place of the single piezo vibrator 31 of the first embodiment, a plurality of divided piezo vibrators 33 corresponding to the partitioned common pressure chamber 36 are provided.

In this embodiment, since divided piezo vibrators 33 are provided for partitioned common pressure chamber 36, compared with the single piezo vibrator 31 for the single common pressure chamber 24, dispersion of pressure wave can be suppressed, and hence generation of strong pressure wave is ensured. Further, precision in bonding divided piezo vibrator 33 on pressure chamber ceiling 16 is high, and efficiency in processing is superior.

Other structure and operation are similar to the first embodiment. Therefore, corresponding portions are denoted by the same reference characters and detailed description is not repeated.

[Ninth Embodiment]

Figure 14:
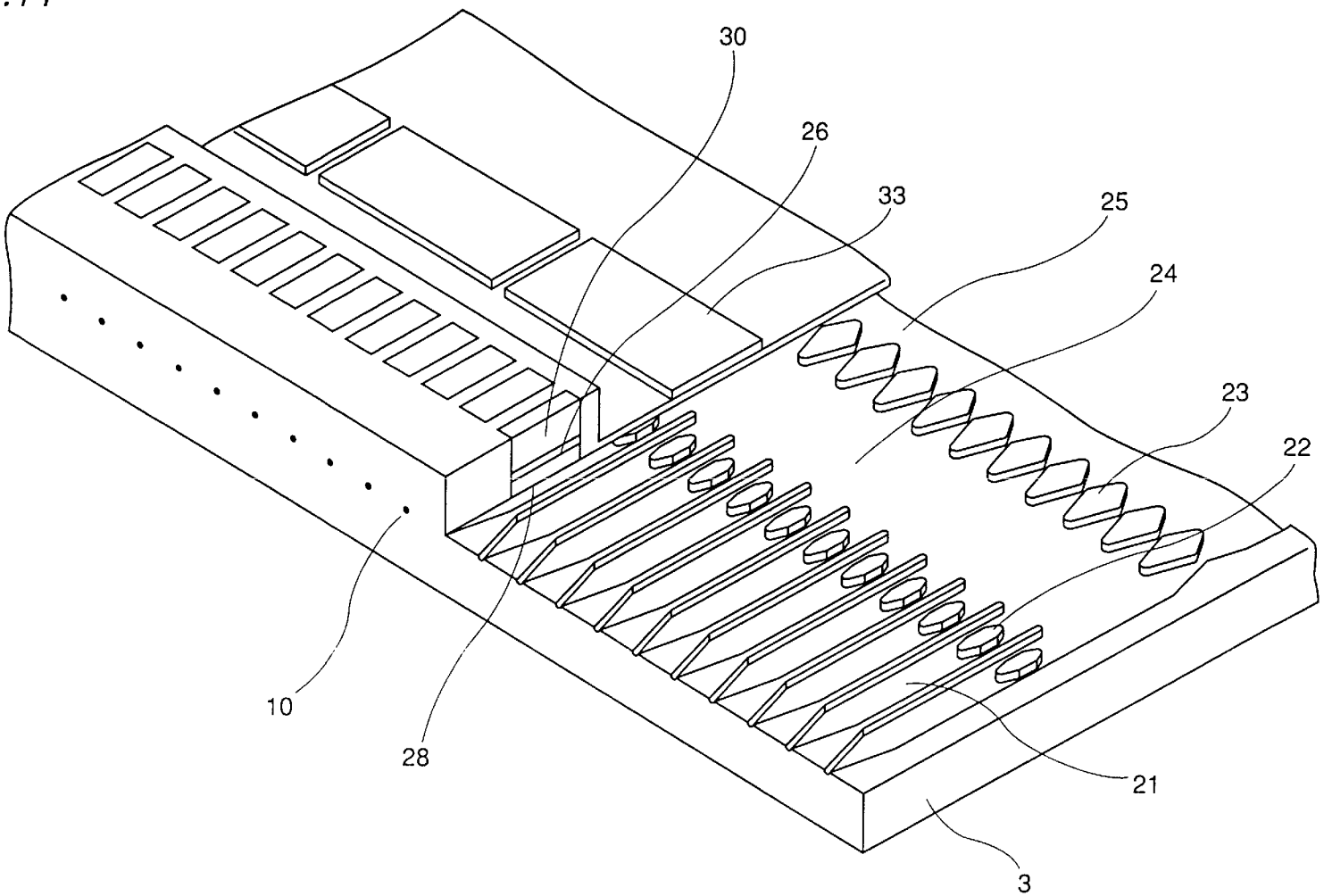
FIG. 14 is a partially exploded perspective view showing an internal structure of a nozzle in accordance with the ink jet print head in accordance with a ninth embodiment.
Figure 15:
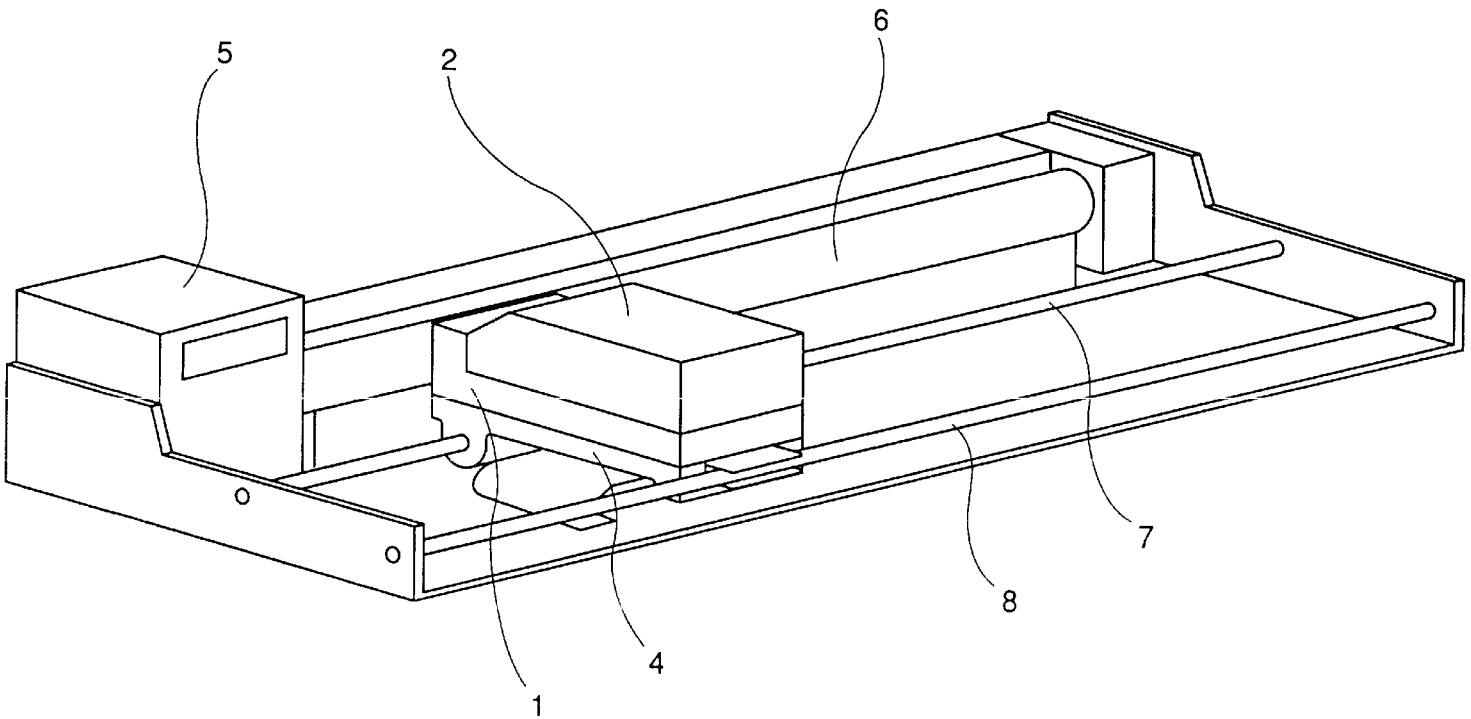
Fig. 15 PRIOR ART
FIG. 15 is a perspective view showing a schematic structure of a conventional serial print type ink jet printer.
Figure 16:
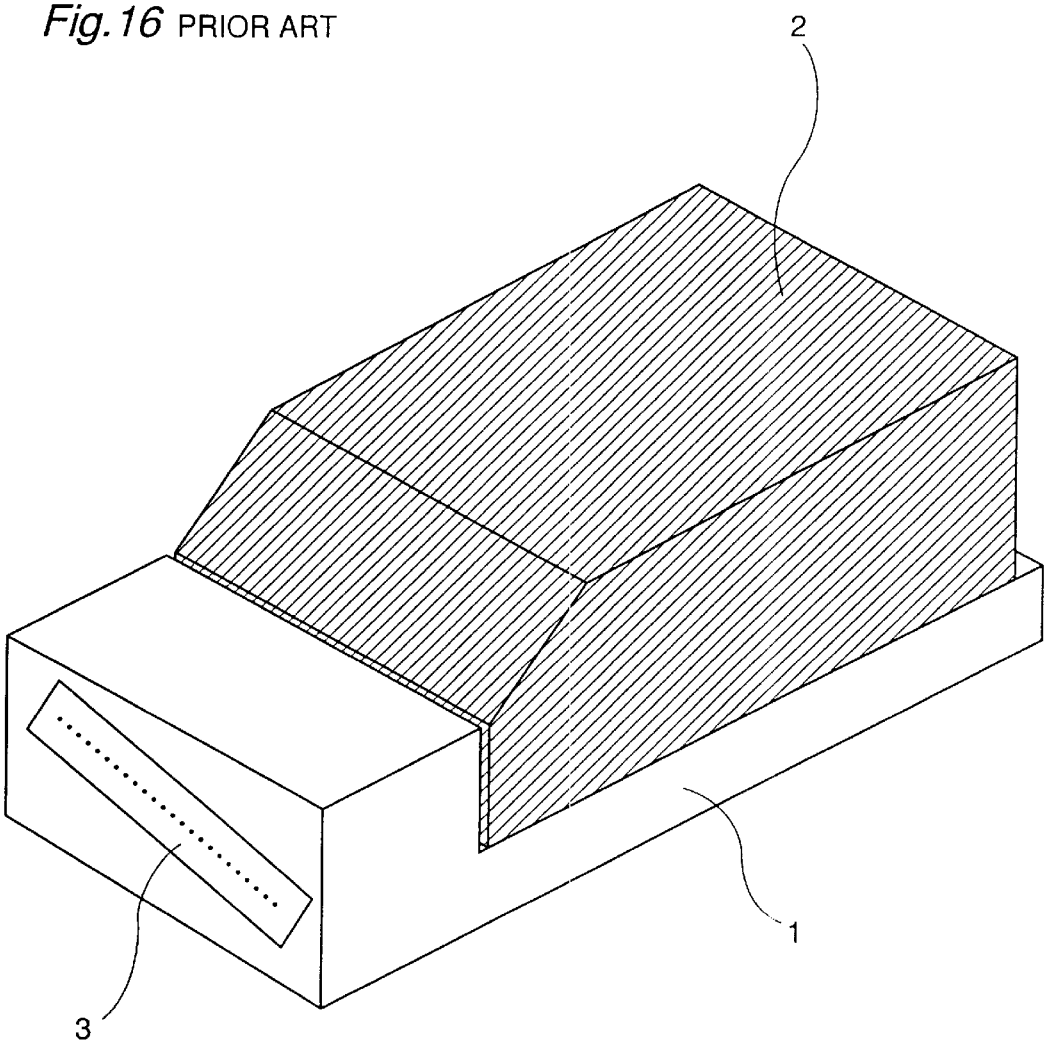
Fig. 16 PRIOR ART
FIG. 16 is a perspective view showing a schematic structure of a conventional serial print type ink jet print head.
Figure 17:
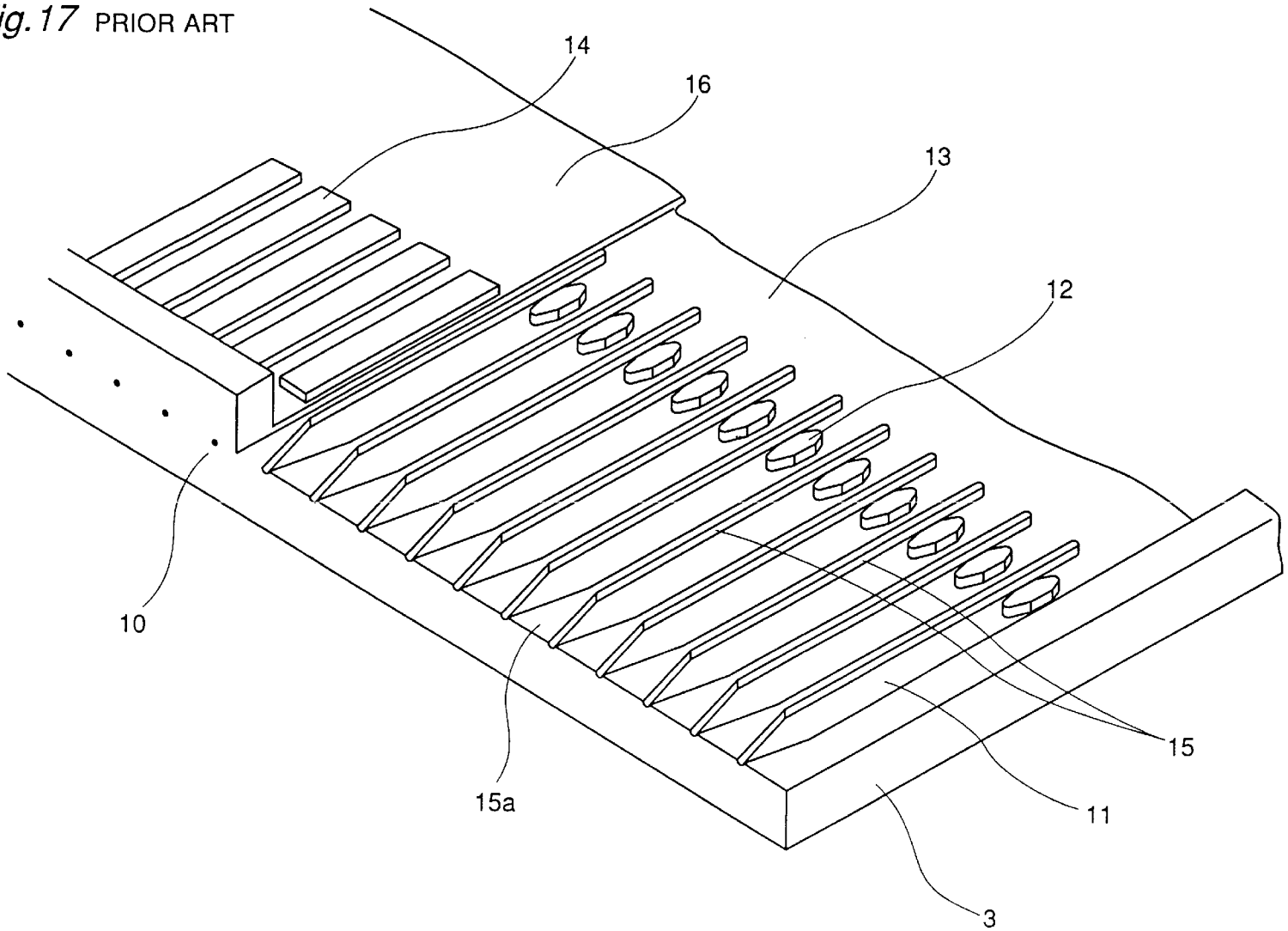
Fig. 17 PRIOR ART
FIG. 17 is a partially exploded perspective view showing an internal structure of a nozzle of a conventional ink jet print head.

Referring to FIG. 14, similar to the first embodiment (FIG. 1), a common pressure chamber 24 may be formed for all ink chambers 21 and in place of the single piezo vibrator 31 of the first embodiment, a plurality of divided piezo vibrators 33 may be provided.

According to the ink jet print head of the present invention, a common pressure chamber is separated by a second filter from a common ink feed path, and pressure wave generated in common pressure chamber by driving a pressure generating member is supplied through a first filter to each ink chamber. Therefore, the ink amount and inner pressure of ink chambers are uniform, and hence the size of ink droplets ejected through orifices when pressure wave from common pressure chamber is received by the ink chambers can be made uniform.

According to the ink jet print head of the second embodiment, ejection/non ejection of ink droplet can be switched in a simple manner, by controlling the timing of deformation of the movable wall.

According to the ink jet print head of the third embodiment, the size of the ejected ink drop can be adjusted in a simple manner by controlling time width of forward offset of the timing to deform movable wall to increase the volume when the ink droplet is to be ejected with respect to the timing of driving the pressure generating member.

According to the ink jet print head of the present invention, the movable wall deformed by the pressure wave is received by a highly resilient member. Therefore, parasitic vibration or deformation of movable wall by pressure wave can be avoided, and ejection/non ejection of the ink droplet can be stably controlled.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An ink jet print head, comprising:

a plurality of ink chambers partitioned from each other and each one of the ink chambers having an orifice formed at a front end portion of each one of the ink chambers;

a common pressure chamber connected to said plurality of ink chambers with a first filter interposed between the common pressure chamber and the plurality of ink chambers;

a common ink feed path connected to said common pressure chamber with a second filter interposed between the common feed path and the common pressure chamber;

a movable wall provided for each one of said plurality of ink chambers, deformable in a direction increasing volume of said ink chamber;

a pressure generating member located on a wall of said common pressure chamber;

means for driving the pressure generating member so that a pressure wave is transmitted to each one of said plurality of ink chambers through said first filter, and said pressure wave is absorbed when said movable wall is deformed, while it ejects an ink droplet through said orifice when said movable wall is not deformed.

2. The ink jet print head according to claim 1, wherein said means for driving the pressure generating member drives the generating pressure member periodically; and whether an ink droplet is to be ejected or not is switched by changing deformation of said movable wall related to time in the direction increasing volume of said ink chamber with respect to driving said pressure generating member related to time.

3. The ink jet print head according to claim 2, wherein size of the ink droplet ejected is adjusted by changing deformation of said movable wall related to time in the direction of increasing the volume of said ink chamber with respect to driving said pressure generating member related to time, when the ink droplet is ejected.

4. The ink jet print head according to claim 3, further comprising a highly resilient member for receiving deformation of said movable wall.

5. The ink jet print head according to claim 1, a size of the ink droplet ejected is adjusted by changing deformation of said movable wall related to time in the direction increasing the volume of said ink chamber with respect to driving said pressure generating member related to time, when the ink droplet is ejected.

6. The ink jet print head according to claim 5, further comprising:

a highly resilient member for receiving deformation of said movable wall.

7. The ink jet print head according to claim 1, further comprising:

a highly resilient member for receiving deformation of said movable wall.

8. The ink jet print head according to claim 2, further comprising:

a highly resilient member for receiving deformation of said movable wall.

9. The ink jet head according to claim 1, wherein the pressure generating member is solely a single element.

10. The ink jet head according to claim 9, wherein the pressure generating member is a piezo vibrator.

11. The ink jet printing head according to claim 1, wherein the second filter prevents the pressure wave from escaping to a side of the common ink path and assists efficient supply of the pressure wave to the plurality of ink chambers.

12. The ink jet printing head according to claim 11, wherein the first filter has a higher fluid resistance than a fluid resistance of the second filter.

13. An ink jet print head, comprising:

a plurality of ink chambers partitioned from each other and each one of the ink chambers having an orifice formed at a front end portion of each one of the ink chambers;

a common pressure chamber connected to said plurality of ink chambers with a first means for filtering interposed between the common pressure chamber and the plurality of ink chambers;

a common ink feed path connected to said common pressure chamber with a second means for filtering interposed between the common feed path and the common pressure chamber;

a movable wall provided for each one of said plurality ink chambers, deformable in a direction increasing volume of said ink chamber;

a pressure generating member located on a wall of said common pressure chamber;

means for driving the pressure generating member so that a pressure wave is transmitted to each one of said plurality of ink chambers through said first filter; and said pressure wave is absorbed when said movable wall is deformed, while it ejects an ink droplet through said orifice when said movable wall is not deformed;

wherein the second means for filtering prevents the pressure wave from escaping to a side of the common ink path and assists efficient supply of the pressure wave to the plurality of ink chambers.

14. The ink jet print head according to claim 13, wherein a size of ink droplet ejected is adjusted by changing deformation of said movable wall related to time in the direction of increasing the volume of said in chamber with respect to driving said pressure generating member related to time, when the ink droplet is ejected.

15. The ink jet print head according to claim 13, further comprising:

a highly resilient member for receiving deformation of said movable wall.

16. The ink jet head according to claim 13, wherein the pressure generating member is solely a single element.

17. The ink jet head according to claim 13, wherein the pressure generating member is a piezo vibrator.

* * * * *

UNITED STATES PATENT AND TRADEMARK OFFICE

CERTIFICATE OF CORRECTION

PATENT NO. : 6,511,157 B1
DATED : January 28, 2003
INVENTOR(S) : Hisashi Yoshimura et al.

It is certified that error appears in the above-identified patent and that said Letters Patent is hereby corrected as shown below:

Title page,
Item [*] Notice, change "0" to -- 846 --.

Signed and Sealed this

Seventh Day of October, 2003

JAMES E. ROGAN
*Director of the United States Patent and Trademark Office*